US007252030B2

(12) United States Patent
Kim

(10) Patent No.: US 7,252,030 B2
(45) Date of Patent: Aug. 7, 2007

(54) HYDRAULIC CONTROL CIRCUIT AND METHOD THEREOF

(75) Inventor: Jin Wook Kim, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 118 days.

(21) Appl. No.: 11/103,890

(22) Filed: Apr. 12, 2005

(65) Prior Publication Data

US 2006/0117942 A1 Jun. 8, 2006

(30) Foreign Application Priority Data

Dec. 7, 2004 (KR) ..... 10-2004-0102232

(51) Int. Cl.
*F15B 13/16* (2006.01)

(52) U.S. Cl. ..... 91/365; 91/433

(58) Field of Classification Search ..... 91/433, 91/365

See application file for complete search history.

(56) References Cited

U.S. PATENT DOCUMENTS 6,286,412 B1 9/2001 Manring et al.

FOREIGN PATENT DOCUMENTS

EP 0 884 482 12/1998
GB 2 298 291 8/1996

*Primary Examiner*—F. Daniel Lopez
(74) *Attorney, Agent, or Firm*—Ladas and Parry LLP

(57) ABSTRACT

Disclosed is a hydraulic control circuit and method thereof for reducing heat generation and energy losses caused by overload. The hydraulic control circuit of the present invention includes a control lever for generating a manipulated signal according to a manipulated variable; a control valve driven by a pilot signal pressure for controlling a flow of the pressurized fluid traveling from the hydraulic pump to the actuator; a displacement sensor for detecting a switching position of the control valve; a pump pressure sensor for detecting a pump pressure applied to the hydraulic pump; an electronic proportional valve for supplying a pilot signal pressure to the control valve; and a controller for receiving the manipulated signal, determining a pilot signal pressure, outputting a control signal to the electronic proportional valve, receiving signals from the displacement sensor and the pump pressure sensor and comparing the signals with pre-stored reference data, and outputting to the electronic proportional valve a stroke error correcting control signal for adjusting the switching position of the control valve.

10 Claims, 7 Drawing Sheets

HYDRAULIC CONTROL CIRCUIT AND METHOD THEREOF

CROSS-REFERENCE TO RELATED APPLICATIONS

This application claims benefit under 35 U.S.C. § 119 from Korean Patent Application No. 2004-102232, filed on Dec. 7, 2004, the entire content of which is incorporated herein by reference.

BACKGROUND OF THE INVENTION

1. Field of the Invention

The present invention relates in general to a hydraulic control circuit, more specifically, to a hydraulic control circuit for reducing heat generation and energy losses due to overload upon a hydraulic pump by adjusting switching position of a control valve through feedback control.

2. Description of the Related Art

Heavy construction machinery and equipment such as an excavator uses a hydraulic control circuit for driving a work machine including a boom and an arm. The operation of the work machine is made possible through an actuator such as a hydraulic cylinder. In general, a constant flow of fluid is discharged from a hydraulic pump discharges and the pressurized fluid is supplied to a hydraulic cylinder by a control valve. The pressurized fluid from the hydraulic cylinder is then collected to a reserve tank and used to drive the actuator.

FIG. 1 is a schematic view of a related art hydraulic control circuit. The hydraulic control circuit of this particular example corresponds to a positive hydraulic control system.

According to the positive hydraulic control system, a hydraulic pump 1 discharges a pressurized fluid flow that is proportional to the manipulated variable of a control lever 4, in order to drive a hydraulic cylinder 2. The configuration and operating relation of the related art hydraulic control system will now be explained below.

The pressurized fluid discharged from the hydraulic pump 1 is supplied to the hydraulic cylinder 2 by a control valve 3. The control valve 3 starts operating by the application of a pilot signal pressure that is generated when the control lever 4 is manipulated. Therefore, the pressurized fluid from the hydraulic pump 1 is supplied to the hydraulic cylinder 2 and the pressurized fluid from the hydraulic cylinder 2 is discharged to a reserve tank T.

A controller 5 controls the hydraulic pump 1 to ensure that the hydraulic pump 1 discharges a pressurized fluid flow that is proportional to the manipulated variable of the control lever 4. To this end, a pressure sensor 9 for detecting a pilot signal pressure is installed on a pilot signal line of the control lever 4, and the pilot signal pressure detected by the pressure sensor 9 is inputted to the controller 5 in form of an electrical signal. The electrical signal of the pressure sensor 9 indicates the manipulated variable of the control lever 4. Thus, the controller 5 operates a corresponding flow out of the input signal from the pressure sensor 9, and transfers a control signal to an electronic depressurizing valve 7. The electronic depressurizing valve 7 receives the control signal from the controller 5, and controls a regulator 8 to control an output flow of the hydraulic pump 1. The control of the output flow of the hydraulic pump 1 is performed in proportion to the manipulated variable of the control lever 4.

However, a problem lies with the above-described related art technique. For example, although it is possible to control the manipulated variable of the control lever 4 (i.e., the output flow of the hydraulic pump 1 can be controlled in accordance with the pilot pressure), a stroke of the control valve 3 is not formed proportionally to the pilot pressure. In result, an overload is applied to the hydraulic pump 1.

To control the speed of a work machine in the heavy construction machinery and equipment, the control valve 3 of the hydraulic control system controls the flow of the pressurized fluid. The spool of the control valve 3 has an orifice forming a passage (or flow channel) for the pressurized fluid. When a pilot signal pressure is applied to the control valve 3, the spool moves and the sectional area of the passage is changed. In consequence, the flow of the pressurized fluid passing through the control valve 3 is changed and thus, the speed of a work machine is controlled.

On the other hand, a work machine such as a boom drops due to its own weight, so the control valve 3 controlling the boom uses a meter-out orifice with an extremely small sectional area, functioning as a passage between the hydraulic cylinder and the reserve tank. As such, when the pressurized fluid passes through the narrow meter-out orifice, the flow rate increases. At this time, different pressures are applied to the spool land surface, and this unbalance in the pressure generates a flow force inside the control valve 3.

Particularly, the flow force applied to an axial direction of the spool of the control valve 3 has a great effect on the controllability and the servo system of the control valve 3. When the passage area of the orifice is increased by moving the spool, the flow force is applied in an opposite direction to the motion of the spool. In result, a stick effect, where the spool does not move in proportion to the manipulated variable of the control lever 4, is generated.

FIG. 2 is a graph illustrating a relation between pilot signal pressure of a control lever and passage area of a control valve spool; and FIG. 3 is a graph illustrating a relation between pilot signal pressure of a control lever and output flow of a hydraulic pump.

In FIG. 2, C-T1 diagram shows a change in normal passage area changes with respect to a change in pilot signal pressure of a meter-out orifice having the smallest passage area formed in the control valve; P-N diagram shows an area change of a passage connecting a hydraulic pump and a neutral passage and discharging a pressurized fluid to a reserve tank; and P-C diagram shows an area change of a passage connecting the hydraulic pump and a hydraulic cylinder.

C-T2 diagram shows an area change of an abnormal passage of the meter-out orifice. According to the C-T2 diagram, even though a pilot signal pressure is inputted to the control valve, the spool does not move properly by the flow force, creating a stagnation. As a result, the amount of the change in passage area of the meter-out orifice is extremely small compared with the C-T1 diagram.

As shown in FIG. 3, when the pilot signal pressure increases by greatly manipulating the control lever, the output flow of the hydraulic pump increases a lot. However, if the operation state of the control valve spool corresponds to the C-T2 diagram by the application of flow force, a great flow force is generated when a large amount of pressurized fluid discharged from the hydraulic pump passes through the meter-out orifice. In such case, overload is applied to the hydraulic pump 1, and the spool does not move proportionally to the manipulated variable of the control lever.

FIG. 4 is a graph illustrating a relation between pilot signal pressure of the control lever and stroke of the control valve spool; and FIG. 5 is a graph illustrating a relation between the pilot signal pressure with respect to time and pump pressure.

In FIG. 4, the solid line A represents the normal stroke of the spool of the control valve 3 when the spool moves by the pilot signal pressure, and the dotted line B represents the abnormal stroke of the spool of the control valve 3.

In FIG. 5, the oblique line C represents a change in pump pressure when the control valve is in normal operation; and the dotted line D represents a change in pump pressure when overload is applied to the hydraulic pump.

Referring to FIG. 4, under the normal operation of the control valve 3 the spool moves in proportion to the magnitude of an input pilot signal pressure to the control valve 3. On the other hand, if a great flow force is generated and thus the operation of the control valve 3 is abnormal, the stroke of the spool is not proportional to the magnitude of the pilot signal pressure. For example, as shown in the dotted line B, the spool of the control valve 3 is stationary despite the pilot signal pressure increase, and suddenly starts moving at a certain point.

Therefore, when the control valve 3 is in abnormal operation, overload is applied to the hydraulic pump 1 as shown in the oblique line D of FIG. 5. The overload on the hydraulic pump 1 is the main cause of energy losses. The stationary state of the spool of the control valve 3 despite the pilot signal pressure increase means that the maneuverability of the equipment is markedly deteriorated.

The flow force generated in the control valve 3 not only affects the controllability and the servo system of the control valve 3 but also causes energy losses. Therefore, to secure safety of the control valve 3 and the entire hydraulic control system, it is necessary to overcome the flow force applied to the spool of the control valve 3.

As an attempt to reduce or compensate the magnitude of the flow force, the spool of the control valve 3 and the sleeve were transformed or the structure of the control valve 3 was changed. In practice, however, these techniques were not useful for the control valve 3. In addition, no matter how much the structure of the control valve 3 was changed, the flow force was not removed completely. This made it more difficult to design a highly stable hydraulic control system.

SUMMARY OF THE INVENTION

It is, therefore, an object of the present invention to provide a hydraulic control circuit and method thereof, wherein a circuit pressure is stably maintained and driving of an actuator is more effective and accurate.

It is another object of the preset invention to reduce heat generation and energy losses caused by the overload on a hydraulic control circuit by adjusting the switching position of a control valve through feedback control and preventing overload on a hydraulic pump.

It is yet another object of the present invention to provide a hydraulic control circuit and method thereof, wherein if a control valve does not properly operated in proportion to the manipulated variable of a control lever due to the application of a flow force on the control valve, the switching position of the control valve is adjusted through feedback control, whereby maneuverability and hydraulic control of the hydraulic control circuit can be greatly improved.

To achieve the above object, there is provided a hydraulic control circuit for driving an actuator by controlling a pressurized fluid from a hydraulic pump, the hydraulic control circuit including: a control lever for generating a manipulated signal according to a manipulated variable; a control valve installed on a supply line connecting the hydraulic pump and the actuator and driven by a pilot signal pressure for controlling a flow of the pressurized fluid traveling from the hydraulic pump to the actuator; a displacement sensor installed on an end of the control valve for detecting a switching position of the control valve; a pump pressure sensor installed on the supply line for detecting a pump pressure applied to the hydraulic pump; at least one electronic proportional valve driven by an external control signal for supplying a pilot signal pressure to the control valve; and a controller for receiving the manipulated signal from the control lever to determine a pilot signal pressure to be supplied to the control valve, outputting a corresponding control signal to the electronic proportional valve(s), receiving signals from the displacement sensor and the pump pressure sensor and comparing the signals with pre-stored reference data, and outputting to the electronic proportional valve(s) a stroke error correcting control signal for adjusting the switching position of the control valve.

Another aspect of the present invention provides a hydraulic control method for driving an actuator by operating a control valve by means of an electronic proportional valve following the manipulation of a control lever, and controlling a pressurized fluid discharged from a hydraulic pump, in which the method includes the steps of: receiving a manipulated signal generated from the control lever according to a manipulated variable; in correspondence to the manipulated signal, determining a pilot signal pressure to be supplied to the control valve and outputting a corresponding control signal to the electronic proportional valve; receiving a signal from a pump pressure sensor detecting a pump pressure applied to the hydraulic pump, and a signal from a displacement sensor detecting a switching position of the control valve; comparing the signals from the pump pressure sensor and the displacement sensor with pre-stored reference data, and deciding whether the control valve is in normal operation; and if the control valve is not in normal operation, outputting to the electronic proportional valve a stroke error correcting control signal for adjusting the switching position of the control valve.

Preferably, if an error is found in both switching position of the control valve and the pump pressure compared with the reference data of a present pilot signal pressure, it is decided that the control valve is in normal operation, and the stroke error correcting control signal for adjusting the switching position of the control valve is outputted to the electronic proportional valve.

Preferably, the reference data comprises displacement of the switching position of the control valve with respect to a change in the pilot signal pressure, and variation of the pump pressure with respect to a change in the pilot signal pressure.

Preferably, the reference data comprises displacement of the switching position of the control valve with respect to a change in the pilot signal pressure, and variation of the pump pressure with respect to the displacement of the control valve.

Preferably, the variation of the pump pressure stored as the reference data is in a range between a maximum pump pressure and a minimum pump pressure that are determined in consideration of work tolerance of the control valve.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 6:
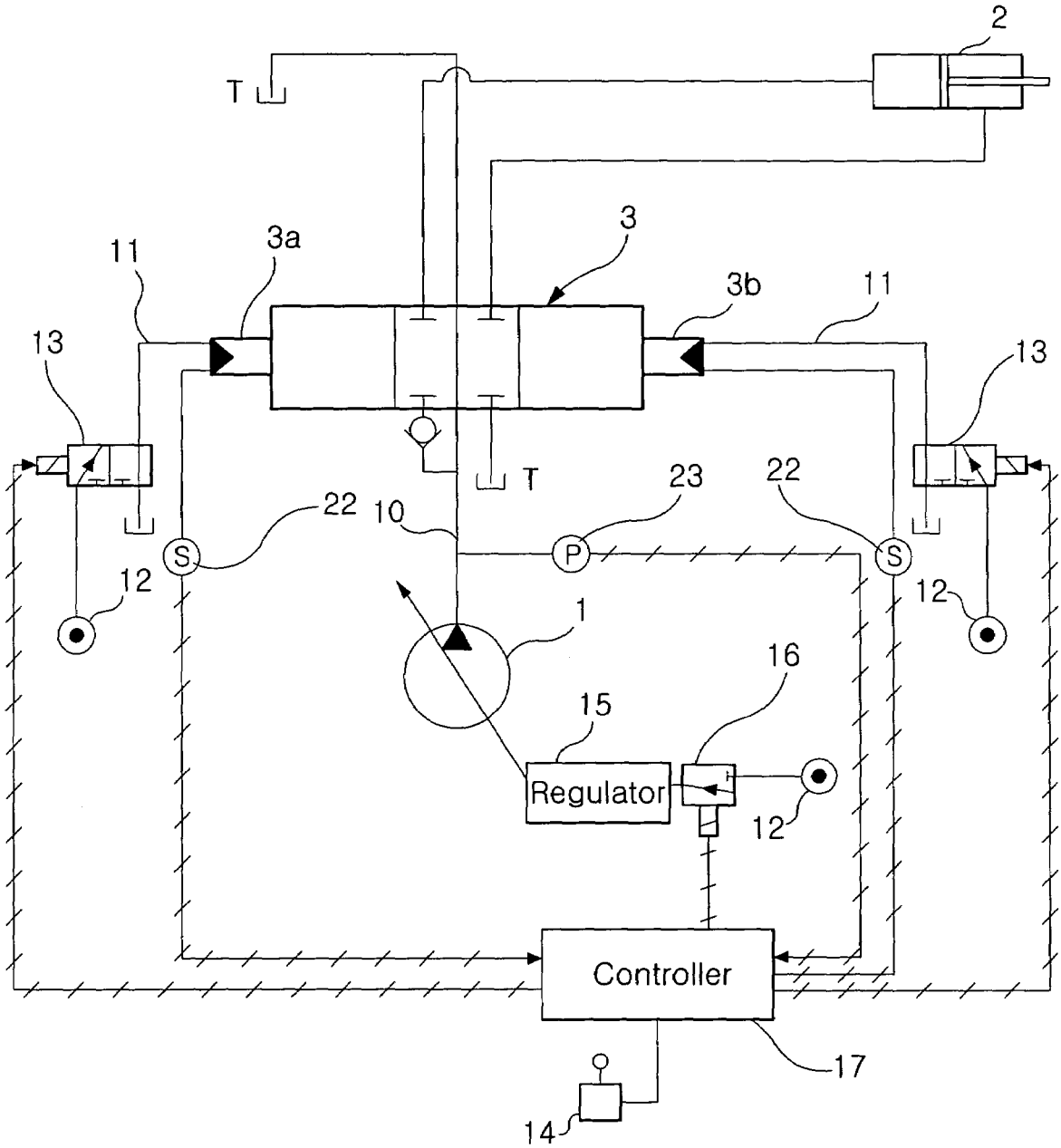
FIG. 6 is a schematic view of a hydraulic control circuit according to one embodiment of the present invention.
Figure 7:
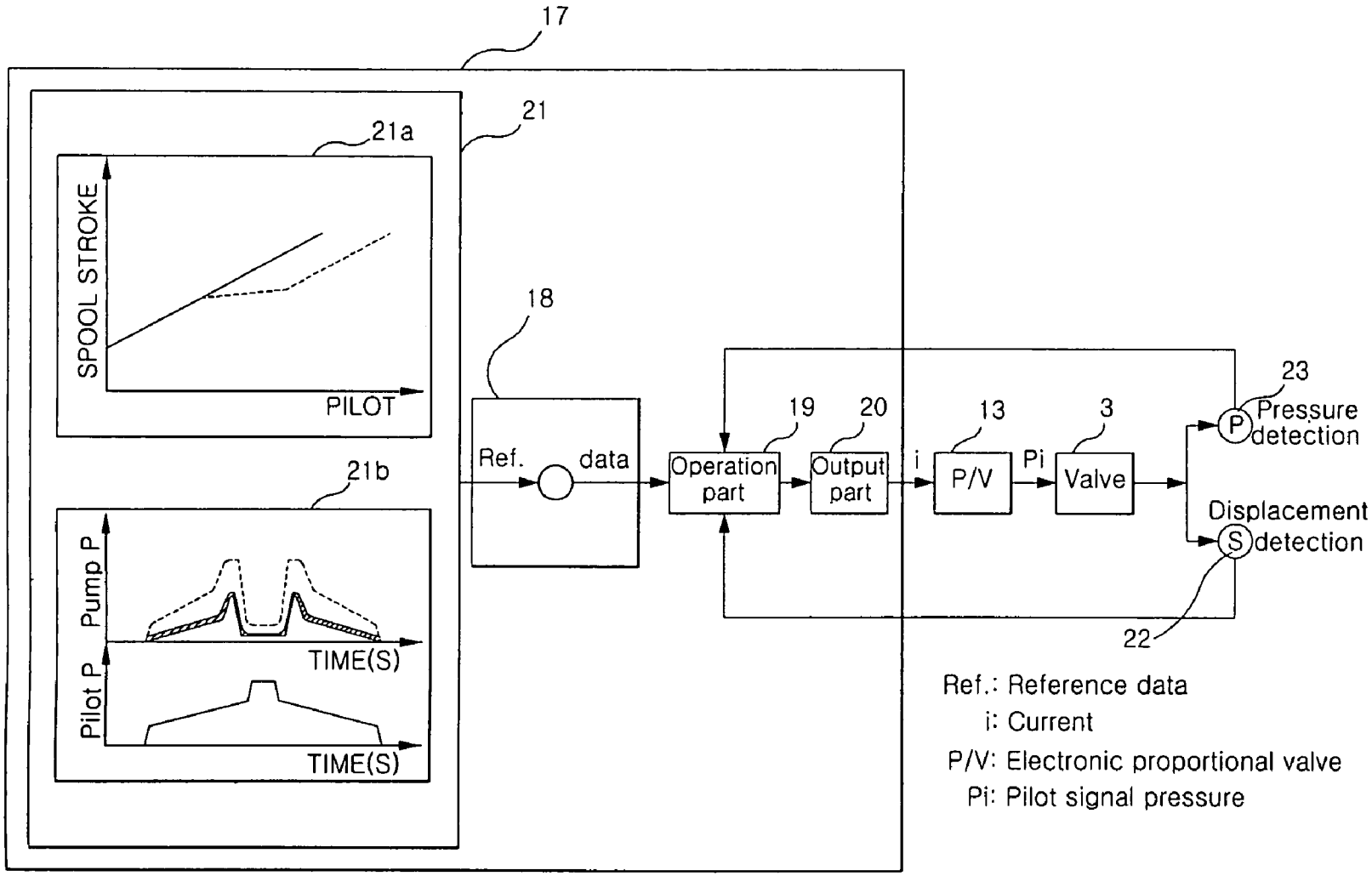
FIG. 7 is a schematic view illustrating a signal flow of a hydraulic control circuit according to one embodiment of the present invention.

FIG. 6 is a schematic view of a hydraulic control circuit according to one embodiment of the present invention; and FIG. 7 is a schematic view illustrating a signal flow of a hydraulic control circuit according to one embodiment of the present invention.

The hydraulic control circuit of the present invention includes a hydraulic pump 1 for discharging a pressurized fluid, and a control valve 3 which drives a hydraulic cylinder 2 by supplying the pressurized fluid provided from the hydraulic pump 1 to the hydraulic cylinder 2 (which is an actuator) and exhausting the pressurized fluid from the hydraulic cylinder 2 to a reserve tank T.

The control valve 3 is installed on a supply line 10 connecting the hydraulic pump 1 and the hydraulic cylinder 2, and pilot inlets 3*a*, 3*b* connected to a pilot signal line 11 are formed on both ends of the control valve. The pilot signal line 11 functions as a passage for a pilot signal power generated from a pilot pump 12. Also, a spool (not shown) is slidably installed in the control valve 3. Therefore, when a pilot signal pressure is inputted through the pilot signal line 11, the spool (not shown) moves in the horizontal direction.

Figure 1:
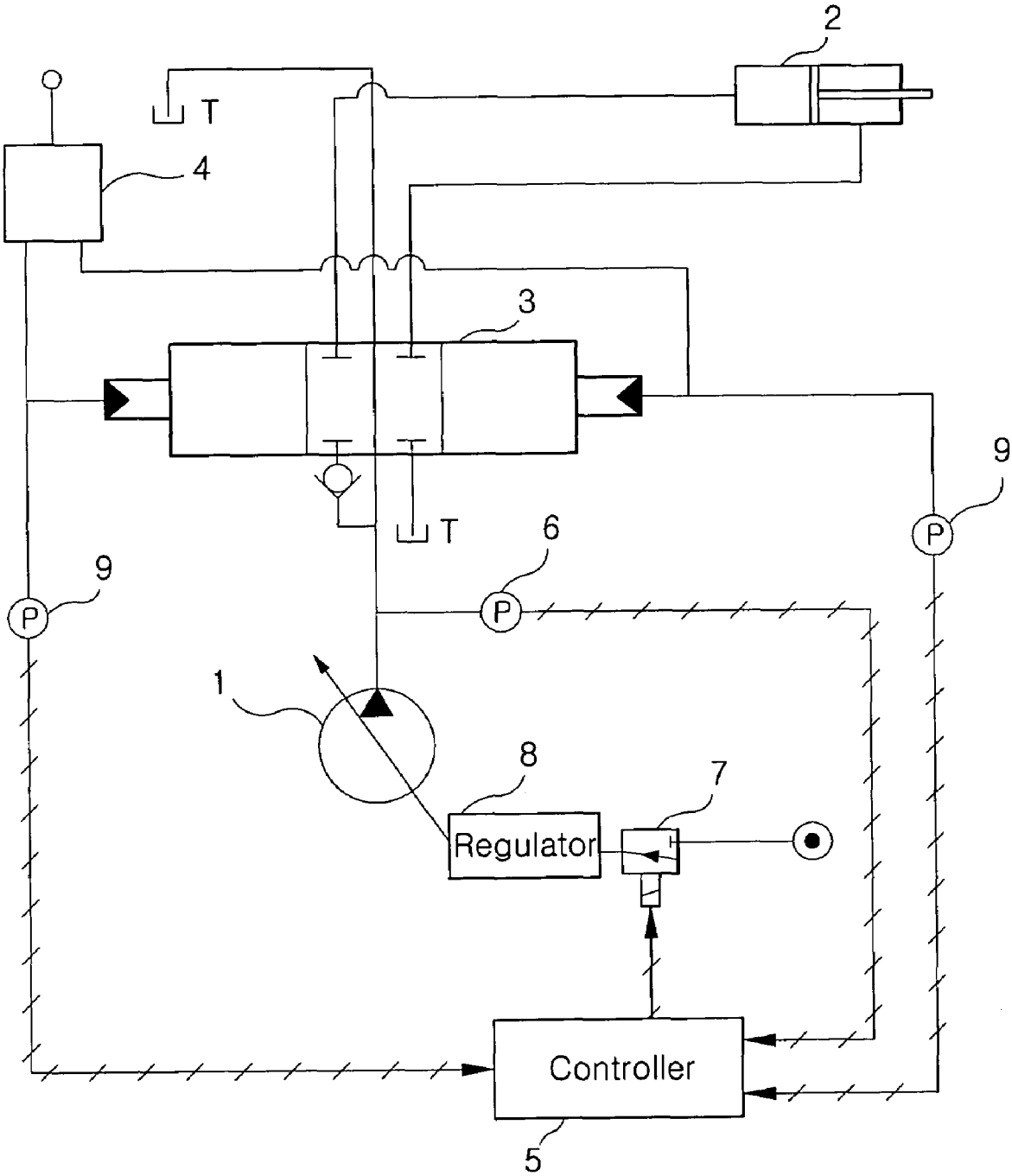
Fig.1 Prior Art
FIG. 1 is a schematic view of a related art hydraulic control circuit.
Figure 2:
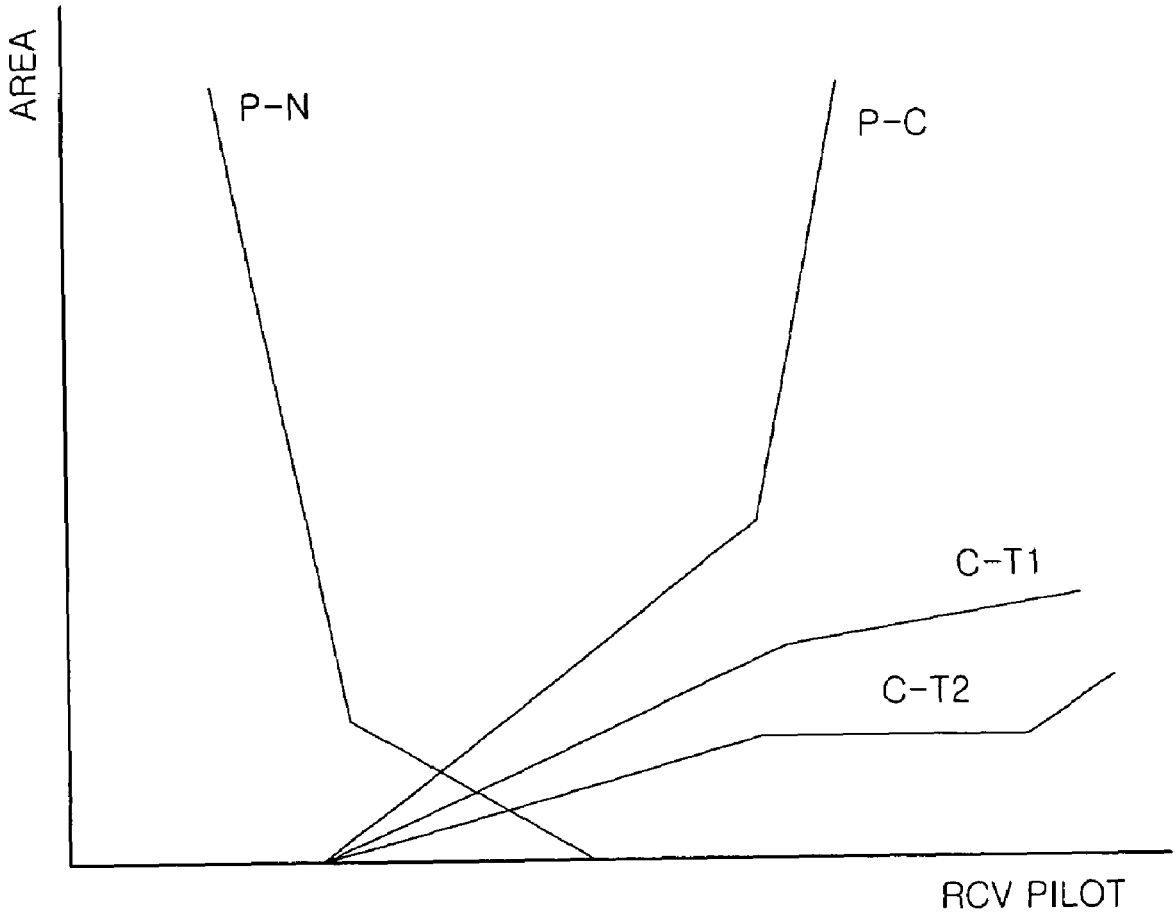
Fig. 2 Prior Art
FIG. 2 is a graph illustrating a relation between pilot signal pressure of a control lever and passage area of a control valve spool.
Figure 3:
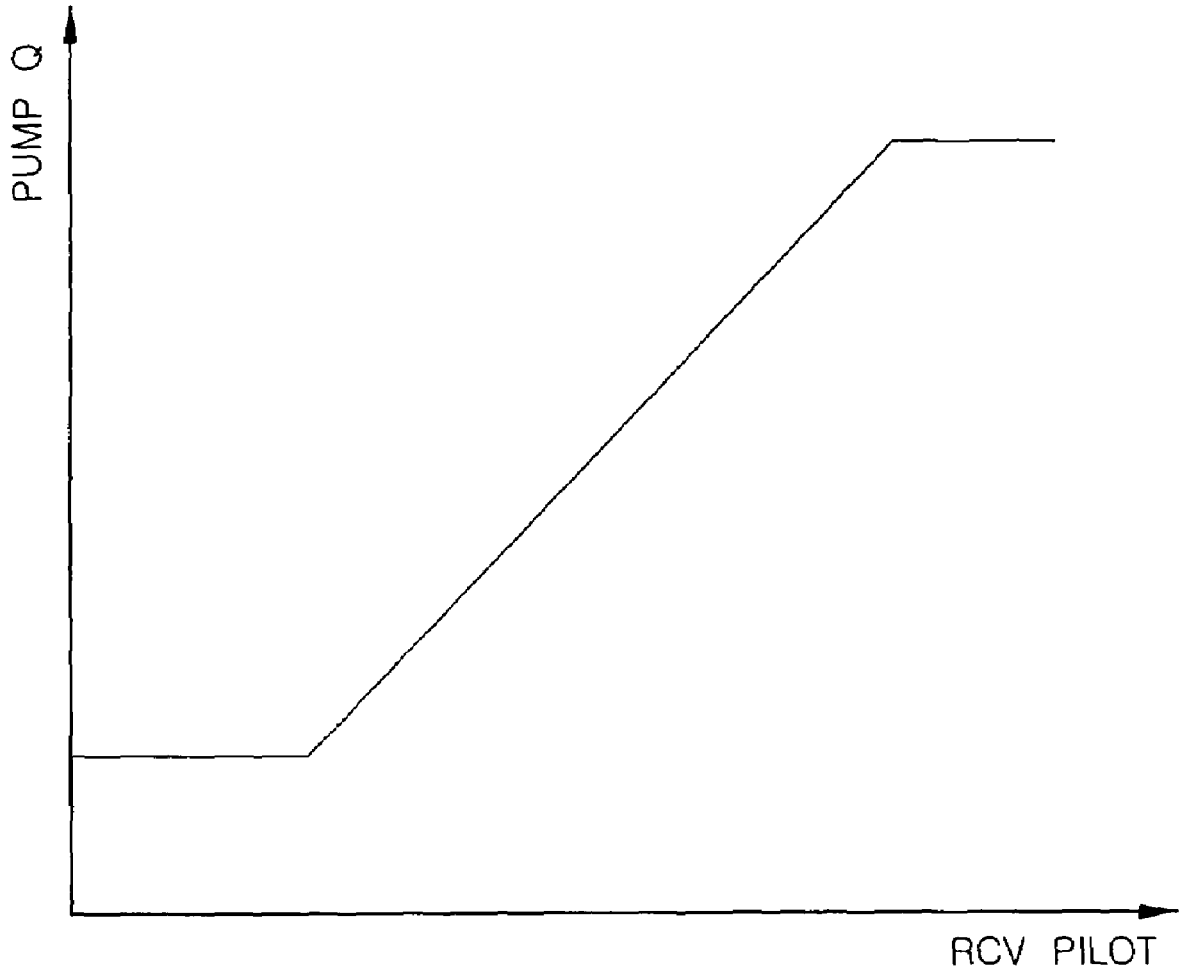
Fig. 3 Prior Art
FIG. 3 is a graph illustrating a relation between pilot signal pressure of a control lever and output flow of a hydraulic pump.
Figure 4:
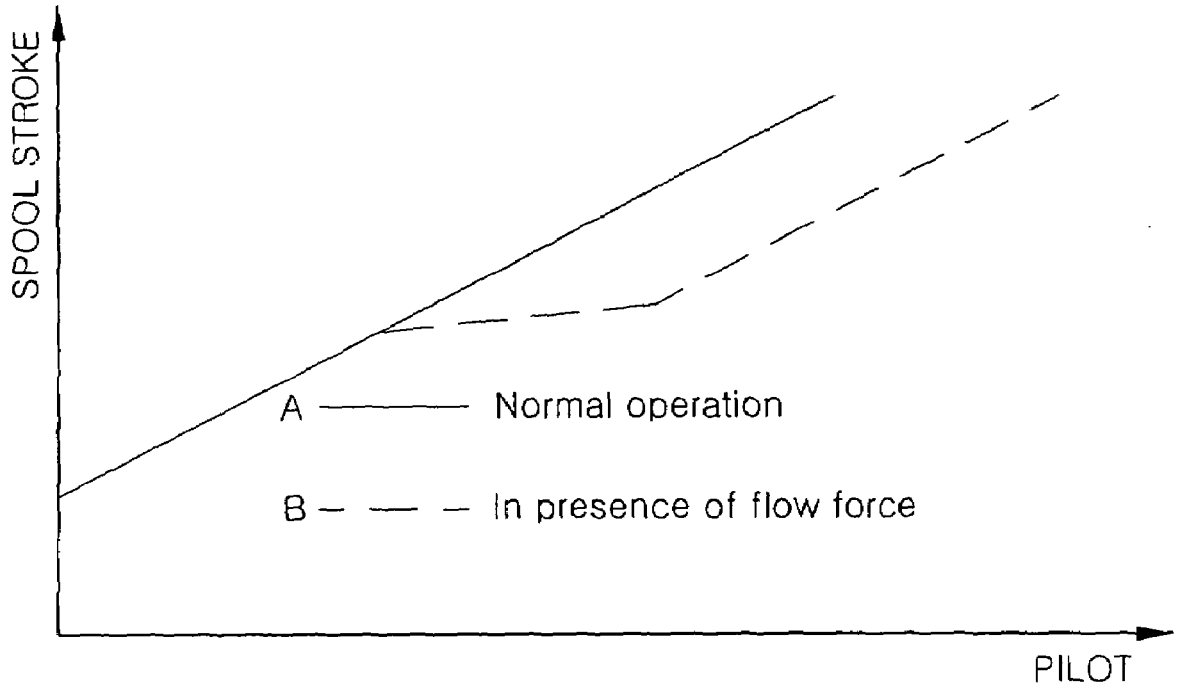
Fig. 4 Prior Art
FIG. 4 is a graph illustrating a relation between pilot signal pressure of a control lever and stroke of a spool of the control valve.
Figure 5:
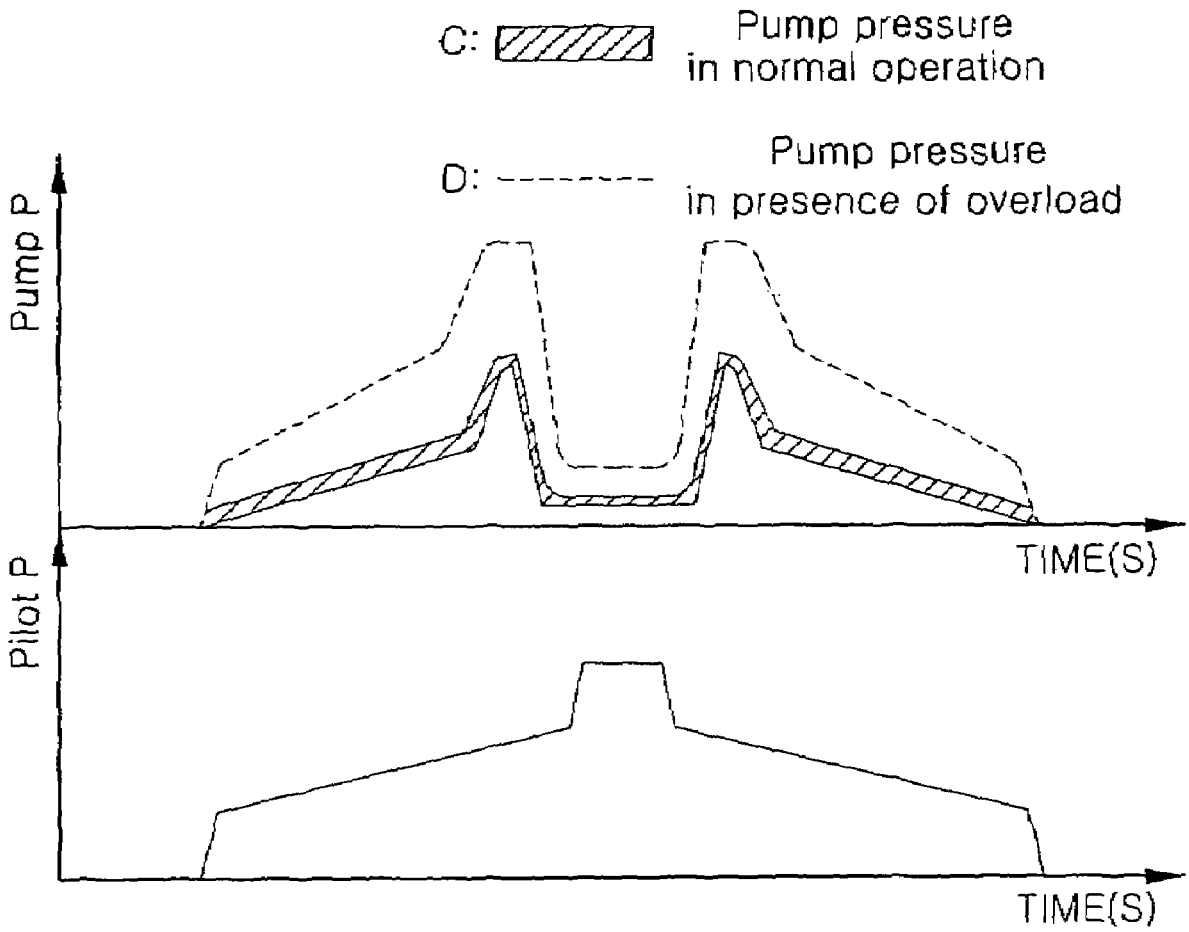
Fig. 5 Prior Art
FIG. 5 is a graph illustrating a relation between pilot signal pressure with respect to time and pump pressure.

Although it is not shown in FIG. 1, a passage (or flow channel) is formed on outside of the spool to connect the hydraulic pump 1, the reserve tank T, and the hydraulic cylinder 2, respectively. As the spool moves horizontally inside the control valve 3, the passages are either opened or closed and the areas of those passages are changed. As a result thereof, the flow passing through the control valve 3 is changed.

An electronic proportional valve 13 is installed on the pilot signal line 11 connected to the pilot pump 12. The electronic proportional valve 13 starts operating in response to a control signal from a controller 17 (this will be described later), and supplies a pilot signal pressure to the pilot inlets 3*a*, 3*b* of the control valve 3.

A receiving part 18 of the controller 17 is connected to a control lever 14, in order to receive a manipulated signal. An operating part 19 operates a control signal corresponding to the manipulated signal, and an output part 20 transfers the control signal to the electronic proportional valve 13. That is, the control lever 14 outputs a manipulated signal proportional to a manipulated variable, whereas the controller 17 operates a flow corresponding to the manipulated signal and outputs its corresponding manipulated signal to the electronic proportional valve 13. As the control lever 14, the controller 17 and the electronic proportional valve 13 interwork with each other, the control valve 3 is switched proportionally to the manipulated variable of the control lever 14, and a pressurized fluid from the hydraulic pump 1 is supplied to the hydraulic cylinder 2 for its operation.

Preferably, the hydraulic pump 1 is a variable displacement hydraulic pump whose output flow is controlled by a regulator 15. The regulator 15 is driven by an electronic depressurizing valve 16 that is controlled by a control signal from the controller 17. In other words, the controller 17 controls the hydraulic pump 1 by controlling the electronic depressurizing valve 16 in correspondence to the manipulated variable of the control lever 14.

Besides controlling the hydraulic pump 1, the controller 17 in the hydraulic control circuit according to the present invention controls the electronic proportional valve 13 in correspondence to the manipulated variable of the control lever 14. In result, the control valve 3 is switched and the hydraulic cylinder 2 is driven. In another case, if a great flow force is applied to an axial direction of the spool of the control valve 3 the spool does not move proportionally to the manipulated variable of the control lever 14, and overload is applied to the hydraulic pump 1. In such case, the controller 17 executes a function by preventing the overload on the hydraulic pump 1.

A displacement sensor 22 is installed on the end of the control valve 3. The displacement sensor 22 detects a switching position of the control valve 3 and outputs a displacement signal (which is an electric signal). Here, the switching position of the control valve 3 refers to a stroke of the spool of the control valve 3 in correspondence to the manipulated variable of the control lever 14. By utilizing an electric contact type displacement sensor or an optical sensor, the amount of travel of the spool can be detected.

A pump pressure sensor 23 is installed on the supply line between the hydraulic pump 1 and the control valve 3. The pump pressure sensor 23 detects a pump pressure that is applied to the hydraulic pump 1 and outputs a pump pressure signal (which is an electric signal).

The displacement signal from the displacement sensor 22 and the pump pressure signal from the pump pressure sensor 23 are inputted to the receiving part 18 of the controller 17. Then the operating part 19 of the controller 17 compares the pump pressure signal and the displacement signal inputted to the receiving part 18 with reference data 21*a*, 21*b* that is pre-stored in a storage 21, and decides whether the control valve 3 is in normal operation. If it is decided that the control valve 3 is not in normal operation, the output part 20 of the controller 17 outputs a stroke error correcting control signal for adjusting the switching position of the control valve 3.

Preferably, the reference data stored in the storage 21 of the controller 17 include displacement of the switching position 21*a* of the control valve with respect to a change in the pilot signal pressure, and variation of the pump pressure 21*b* with respect to a change in the pilot signal pressure. Although it is not illustrated, variation of the pump pressure with respect to a switching position of the control valve can also be used as the reference data, in replacement of the variation of the pump pressure 21*b* with respect to the pilot signal pressure. Preferably, the variation of the pump pressure is in a range between a maximum pump pressure and a minimum pump pressure that are determined in consideration of work tolerance of the control valve 3.

If an error is found in both switching position of the control valve 3 and the pump pressure compared with the reference data of a present pilot signal pressure, the controller 17 decides that the control valve 3 is not in normal operation, and outputs to the electronic proportional valve 13 a stroke error correcting control signal for adjusting the switching position of the control valve 3.

The following will now discuss the operation of the hydraulic control circuit having the above-described configuration.

The operation of the hydraulic cylinder 2 is made possible through the control valve 3 which controls the flow of a pressurized fluid discharged form the hydraulic pump 1. That is, if a pilot signal pressure is supplied to the pilot inlets 3*a*, 3*b* of the control valve 3 via the pilot signal line 11, the spool of the control valve 3 moves in the horizontal direction (as can be seen in the drawing). In result, the direction of the pressurized fluid supplied from the hydraulic pump 1 to the hydraulic cylinder 2, the direction of the pressurized fluid discharged from the hydraulic cylinder 2 to the reserve tank T, and the flows thereof are controlled, respectively.

The electronic proportional valve 13 starts driving in response to the control signal transferred from the controller 17. Also, the electronic proportional valve 13 provides the pilot inlets 31, 3*b* with a pilot signal pressure formed on the pilot signal line 11 by the pilot pump.

When the control lever 14 is manipulated a manipulated signal in correspondence to the manipulated variable is generated, and transferred to the receiving part 18 of the controller 17. The operating part 19 determines a pilot signal pressure to be supplied to the control valve 3, and outputs its corresponding control signal to the electronic proportional valve 13. Then, the spool of the control valve 3 starts moving and the hydraulic cylinder 2 is driven proportionally to the manipulated variable of the control lever 14.

In the meantime, the receiving part 18 of the controller 17 receives a displacement signal of the spool stroke from the displacement sensor 22 installed on the end of the control valve 3, and a pump pressure signal from the pump pressure sensor 23.

The operating part 19 compares the pump pressure signal and the displacement signal with the reference data 21*a*, 21*b* in the storage 21. If an error is found in both switching position of the control valve 3 and the pump pressure compared with the reference data of a present pilot signal pressure, the controller 17 decides that the control valve 3 is not in normal operation, and outputs to the electronic proportional valve 13 a stroke error correcting control signal for adjusting the switching position of the control valve 3.

The following will now discuss a hydraulic control method using the hydraulic control circuit according to one embodiment of the present invention.

In the first step, the control lever 14 for driving the hydraulic cylinder 2 is manipulated and a manipulated signal generated therefrom is sent to the receiving part 18 of the controller 17.

In the second step, the operating part 19 determines, in correspondence to the manipulated signal provided from the receiving part 18, a pilot signal pressure that needs to be supplied to the control valve, and the output part 20 outputs to the electronic proportional valve 13 a control signal corresponding to the determined pilot signal pressure.

In the third step, the receiving part 18 of the controller 17 receives a pump pressure signal detected by the pump pressure sensor, and a displacement signal of the control valve switching position detected by the displacement sensor.

In the fourth step, the operating part 19 of the controller 17 compares the pump pressure signal and the displacement signal with the data stored in the storage 21, and decides whether the control valve 3 is in normal operation.

Preferably, the reference data include displacement of the switching position 21*a* of the control valve with respect to a change in the pilot signal pressure, and variation of the pump pressure 21*b* with respect to a change in the pilot signal pressure. Although it is not illustrated, variation of the pump pressure with respect to a switching position of the control valve can also be used as the reference data, in replacement of the variation of the pump pressure 21*b* with respect to the pilot signal pressure. Preferably, the variation of the pump pressure is in a range between a maximum pump pressure and a minimum pump pressure that are determined in consideration of work tolerance of the control valve 3.

If an error is found in both switching position of the control valve 3 and the pump pressure compared with the reference data of a present pilot signal pressure, the controller 17 decides that the control valve 3 is not in normal operation.

In the fifth step, if it turns out that the control valve 3 is not in normal operation, the controller 17 outputs to the electronic proportional valve 13 a stroke error correcting control signal for adjusting the switching position of the control valve 3.

According to the present invention hydraulic control circuit and method thereof, if the spool does not move proportionally to the manipulated variable of the control lever 14 due to the flow force on the control valve 3 and overload is applied on the hydraulic pump 1, the controller 17 detects the pump pressure signal and the displacement signal of the control valve and drives the electronic proportional valve 13 through feedback control, in order to adjust the switching position of the control valve 3. In this manner, the overload is no more applied to the hydraulic pump 1 and the control valve 3 works smoothly in correspondence to the manipulation of the control lever 14, resulting in an improvement of the maneuverability of the control lever 14.

In conclusion, according to the hydraulic control circuit of the present invention, the circuit pressure can be stably maintained by adjusting the switching position of the control valve through feedback control and preventing the overload on the hydraulic pump. Since the circuit pressure is stably maintained the performance of the actuator becomes more effective and accurate, and heat generation and energy losses due to the overload can be reduced.

In addition, even if the control valve may not be operated proportionally to the manipulated variable of the control lever due to the influence of the flow force on the control valve, this abnormal operation problem can be solved easily by adjusting the switching position of the control valve through feedback control. As such, the maneuverability of the control lever can be improved and hydraulic control can be done more accurately.

While the invention has been described in conjunction with various embodiments, they are illustrative only. Accordingly, many alternative, modifications and variations will be apparent to persons skilled in the art in light of the foregoing detailed description. The foregoing description is intended to embrace all such alternatives and variations falling with the spirit and broad scope of the appended claims.

What is claimed is:

1. A hydraulic control circuit for driving an actuator by controlling a pressurized fluid from a hydraulic pump, the hydraulic control circuit comprising:

a control lever for generating a manipulated signal according to a manipulated variable;

a control valve installed on a supply line connecting the hydraulic pump and the actuator and driven by a pilot signal pressure for controlling a flow of the pressurized fluid traveling from the hydraulic pump to the actuator;

a displacement sensor installed on an end of the control valve for detecting a switching position of the control valve;

a pump pressure sensor installed on the supply line for detecting a pump pressure applied to the hydraulic pump;

at least one electronic proportional valve driven by an external control signal for supplying a pilot signal pressure to the control valve; and a controller for receiving the manipulated signal from the control lever to determine a pilot signal pressure to be supplied to the control valve, outputting a corresponding control signal to the electronic proportional valve (s), receiving signals from the displacement sensor and the pump pressure sensor and comparing the signals with pre-stored reference data, and outputting to the electronic proportional valve(s) a stroke error correcting control signal for adjusting the switching position of the control valve wherein if an error is found in both switching position of the control valve and the pump pressure compared with the reference data of a present pilot signal pressure, the controller outputs to the electronic proportional valve (s) the stroke error correcting control signal for adjusting the switching position of the control valve.

2. The hydraulic control circuit according to claim 1, wherein the reference data comprises displacement of the switching position of the control valve with respect to a change in the pilot signal pressure, and variation of the pump pressure with respect to a change in the pilot signal pressure.

3. The hydraulic control circuit according to claim 2, wherein the variation of the pump pressure stored as the reference data is in a range between a maximum pump pressure and a minimum pump pressure that are determined in consideration of work tolerance of the control valve.

4. The hydraulic control circuit according to claim 1, wherein the reference data comprises displacement of the switching position of the control valve with respect to a change in the pilot signal pressure, and variation of the pump pressure with respect to the displacement of the control valve.

5. The hydraulic control circuit according to claim 4, wherein the variation of the pump pressure stored as the reference data is in a range between a maximum pump pressure and a minimum pump pressure that are determined in consideration of work tolerance of the control valve.

6. A hydraulic control method for driving an actuator by operating a control valve by means of an electronic proportional valve following the manipulation of a control lever, and controlling a pressurized fluid discharged from a hydraulic pump, the method comprising the steps of:

receiving a manipulated signal generated from the control lever according to a manipulated variable;

in correspondence to the manipulated signal, determining a pilot signal pressure to be supplied to the control valve and outputting a corresponding control signal to the electronic proportional valve;

receiving a signal from a pump pressure sensor detecting a pump pressure applied to the hydraulic pump, and a signal from a displacement sensor detecting a switching position of the control valve;

comparing the signals from the pump pressure sensor and the displacement sensor with pre-stored reference data, and deciding whether the control valve is in normal operation; and if the control valve is not in normal operation, outputting to the electronic proportional valve a stroke error correcting control signal for adjusting the switching position of the control valve wherein in the step of deciding an operation state of the control valve, if an error is found in both switching position of the control valve and the pump pressure compared with the reference data of a present pilot signal pressure, the operation state of the control valve is not normal.

7. The method according to claim 6, wherein the reference data comprises displacement of the switching position of the control valve with respect to a change in the pilot signal pressure, and variation of the pump pressure with respect to a change in the pilot signal pressure.

8. The method according to claim 7, wherein the variation of the pump pressure stored as the reference data is in a range between a maximum pump pressure and a minimum pump pressure that are determined in consideration of work tolerance of the control valve.

9. The method according to claim 6, wherein the reference data comprises displacement of the switching position of the control valve with respect to a change in the pilot signal pressure, and variation of the pump pressure with respect to the displacement of the control valve.

10. The method according to claim 9, wherein the variation of the pump pressure stored as the reference data is in a range between a maximum pump pressure and a minimum pump pressure that are determined in consideration of work tolerance of the control valve.

* * * * *